US010850893B2

(12) United States Patent
Rusch

(10) Patent No.: US 10,850,893 B2
(45) **Date of Patent: *Dec. 1, 2020**

(54) DISPENSERS WITH DIVERTER INSERTS

(71) Applicant: Server Products, Inc., Richfield, WI (US)

(72) Inventor: Gerald A. Rusch, Fond du Lac, WI (US)

(73) Assignee: Server Products, Inc., Richfield, WI (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/846,634

(22) Filed: Apr. 13, 2020

(65) Prior Publication Data

US 2020/0239197 A1 Jul. 30, 2020

Related U.S. Application Data

(63) Continuation of application No. 16/152,511, filed on Oct. 5, 2018, now Pat. No. 10,654,622.

(51) Int. Cl.
*B65D 35/30* (2006.01)
*B65D 35/38* (2006.01)

(52) U.S. Cl.
CPC ..... *B65D 35/30* (2013.01); *B65D 35/38* (2013.01)

(58) Field of Classification Search
CPC ..... B65D 35/30; B65D 35/38
USPC ..... 222/387, 481, 484, 485, 488, 494, 547, 222/564
See application file for complete search history.

(56) References Cited

U.S. PATENT DOCUMENTS

| | | | |
|---|---|---|---|
| 2,507,557 | A | 5/1950 | Chester |
| 2,634,692 | A | 4/1953 | Sherbondy |
| 3,161,325 | A | 12/1964 | Hinkel |
| 3,168,059 | A | 2/1965 | Germann |
| 3,174,653 | A | 3/1965 | McEachran |
| 3,591,053 | A | 7/1971 | Thomas |
| 3,884,396 | A | 5/1975 | Gordon et al. |
| 4,318,499 | A | 3/1982 | Hamilton |
| 4,323,176 | A | 4/1982 | Sartain |
| 4,768,683 | A | 9/1988 | Gold et al. |
| 4,830,231 | A | 5/1989 | Smith |
| 4,966,537 | A | 10/1990 | Bowles et al. |
| 5,277,318 | A | 1/1994 | Smalley, Jr. et al. |
| 5,297,702 | A | 3/1994 | Crosby et al. |
| 5,375,740 | A | 12/1994 | Umetsu et al. |

(Continued)

OTHER PUBLICATIONS

Extended European Search Report for European Patent Application No. 19201019.7 dated Feb. 26, 2020.

*Primary Examiner* — Patrick M. Buechner
*Assistant Examiner* — Michael J. Melaragno
(74) *Attorney, Agent, or Firm* — Andrus Intellectual Property Law, LLP

(57) ABSTRACT

A dispenser for dispensing a viscous material contained in a flexible package has a hollow body extending along a longitudinal axis, a first end with a handle assembly, an opposite second end with a dispensing valve, and a cavity configured to receive the flexible package. A piston is movably disposed in the cavity for engagement with the flexible package to force viscous material from the flexible package. A diverter insert is also disposed in the cavity and is configured to receive the viscous material from the flexible package as the piston moves and divert the viscous material to the dispensing valve.

10 Claims, 4 Drawing Sheets

(56) References Cited

U.S. PATENT DOCUMENTS

| | | | |
|---|---|---|---|
| 5,556,008 | A | 9/1996 | Silver et al. |
| 6,026,985 | A | 2/2000 | Elliott, Sr. |
| 6,176,399 | B1 | 1/2001 | Schantz et al. |
| 6,648,181 | B2 | 11/2003 | Whittaker |
| 6,655,554 | B2 | 12/2003 | Pantelleria et al. |
| 6,732,888 | B1 | 5/2004 | Smiley et al. |
| D521,863 | S | 5/2006 | Davis et al. |
| 7,037,094 | B1 | 5/2006 | Lee |
| 7,959,038 | B2 | 6/2011 | De Oliveira et al. |
| 8,146,781 | B2 | 4/2012 | Robertson et al. |
| 8,256,978 | B2 | 9/2012 | Bencsics et al. |
| 8,511,520 | B2 | 8/2013 | Van Wijk et al. |
| 8,561,854 | B2 | 10/2013 | Tirone et al. |
| D698,616 | S | 2/2014 | Van Wijk et al. |
| 8,650,736 | B2 | 2/2014 | Robertson et al. |
| 9,333,605 | B2 | 5/2016 | Robertson et al. |
| 9,376,239 | B2 | 6/2016 | Edamatsu et al. |
| 9,481,495 | B2 | 11/2016 | Bellmore et al. |
| 9,694,944 | B2 | 7/2017 | Long et al. |
| 10,654,622 | B2 * | 5/2020 | Rusch ..... B65D 35/38 |
| 2005/0167447 | A1 | 8/2005 | Barraclough |
| 2006/0118580 | A1 | 6/2006 | Spencer |
| 2007/0215649 | A1 | 9/2007 | Tirone et al. |
| 2007/0217860 | A1 | 9/2007 | Byun |
| 2008/0023495 | A1 | 1/2008 | Takayama et al. |
| 2008/0245380 | A1 | 10/2008 | Ecker et al. |
| 2009/0159613 | A1 | 6/2009 | Rusch |
| 2010/0089953 | A1 | 4/2010 | Lakic |
| 2011/0121028 | A1 | 5/2011 | Rusch |
| 2012/0228334 | A1 | 9/2012 | Van Wijk et al. |
| 2013/0126558 | A1 | 5/2013 | Schneider et al. |
| 2013/0153600 | A1 | 6/2013 | Sanfilippo et al. |
| 2013/0233886 | A1 | 9/2013 | Long et al. |
| 2014/0008397 | A1 | 1/2014 | Edamatsu et al. |
| 2015/0307236 | A1 | 10/2015 | Bellmore et al. |

* cited by examiner

DISPENSERS WITH DIVERTER INSERTS

CROSS REFERENCE TO RELATED APPLICATION

The present application is a continuation of U.S. patent application Ser. No. 16/152,511, filed Oct. 5, 2018, which has now issued as U.S. Pat. No. 10,654,622 on May 19, 2020, the disclosure of which is incorporated herein by reference.

FIELD

The present disclosure generally relates to dispensers and, more particularly, pertains to hand-held dispensers for discharging viscous materials.

BACKGROUND

A variety of hand-held, manually operated dispensers are known for selectively dispensing thick, flowable viscous materials, such as paste-like extrudable materials in the form of gels, foams, adhesives, and the like. One area in which dispensers of the present disclosure have particular application is the food industry where pre-packaged charges of viscous food products, such as cheese, whipped topping, icing, and food condiments, are to be dispensed.

Many of these food product dispensers include a housing or body for replaceably receiving a flexible package of a food product to be dispensed. The dispenser typically has a dispensing end and a piston slideably mounted within the body. Dispensers of this type usually include a handle having a pivotably mounted trigger which is squeezed by a user to activate a piston advancing arrangement. Such piston advancing arrangement commonly includes an elongated rod that is advanced by a pawl mechanism linking the rod and the piston. One portion of the rod is adapted for contact with the piston and propels the piston as the user manipulates the trigger. As the piston is advanced, the food product is dispensed from the dispensing end.

To refill the dispenser with a new flexible package, the dispenser is disassembled and the new flexible package is inserted. While refilling the dispenser, residual food product at the dispensing end may spill out or be cleaned from the dispensing end. Accordingly, the residual food product is lost thereby increasing costs and refill frequency.

There remains a need for a dispenser that efficiently dispenses the food product such that little or no residual food product is lost or wasted when the dispenser is refilled. Through research and experimentation, the present inventors have developed the dispensers of the present disclosure that increase efficiency and reduce or eliminate the amount of residual food product that is lost when refilling the dispenser.

SUMMARY

In one embodiment, the present disclosure relates to a dispenser for dispensing a viscous material contained in a flexible package. The dispenser includes a hollow body extending along a longitudinal axis with a first end having a handle assembly, an opposite second end including a plurality of dispensing valves, and a cavity configured to receive the flexible package. The handle assembly includes a trigger that can be actuated to move a piston into contact with the flexible package disposed in the cavity for engagement with the flexible package to force the viscous material from the flexible package. A diverter insert is positioned in the cavity and receives the viscous material from the flexible package as the piston moves and diverts the viscous material to the plurality of dispensing valves.

In another embodiment, a dispenser for dispensing a viscous product contained in a flexible package includes a hollow body extending along a longitudinal axis with a first end having a handle assembly, an opposite second end having a plurality of dispensing valves radially offset from the longitudinal axis, and a cavity configured to receive the flexible package. The handle assembly has a piston that is movable within the cavity for engagement with the flexible package. Actuation of a trigger causes movement of the piston to force the viscous material from the flexible package. A diverter insert is positioned in the cavity and configured to receive the viscous material from the flexible package as the piston moves. The diverter insert radially divert the viscous material to the plurality of dispensing valves.

In yet another embodiment, a dispenser for dispensing a viscous product contained in a flexible package includes a hollow body with a cavity extending along a longitudinal axis. The body has a first end with a handle assembly, an opposite second end with a plurality of dispensing valves radially offset from the longitudinal axis, a sidewall that extends between the first end and the second end and with an interior surface, and a wall member that extends radially inwardly from the interior surface into the cavity to divide the cavity into a first cavity portion that receives the flexible package and a second cavity portion. The wall member has a passage there through such that the first cavity portion is in fluid communication with the second cavity portion. The handle assembly has a piston movably disposed in the cavity for engagement with the flexible package such that actuation of a trigger causes movement of the piston to force the viscous material from the flexible package. A diverter insert is positioned in the second cavity portion and is configured to receive the viscous material from the flexible package as the piston moves. The diverter insert radially diverts the viscous material to the plurality of dispensing valves.

Various other features, objects and advantages of the invention will be made apparent from the following description taken together with the drawings.

BRIEF DESCRIPTION OF THE DRAWINGS

The drawings illustrate modes presently contemplated of carrying out the present disclosure. In the drawings.

DETAILED DESCRIPTION

Figure 1:
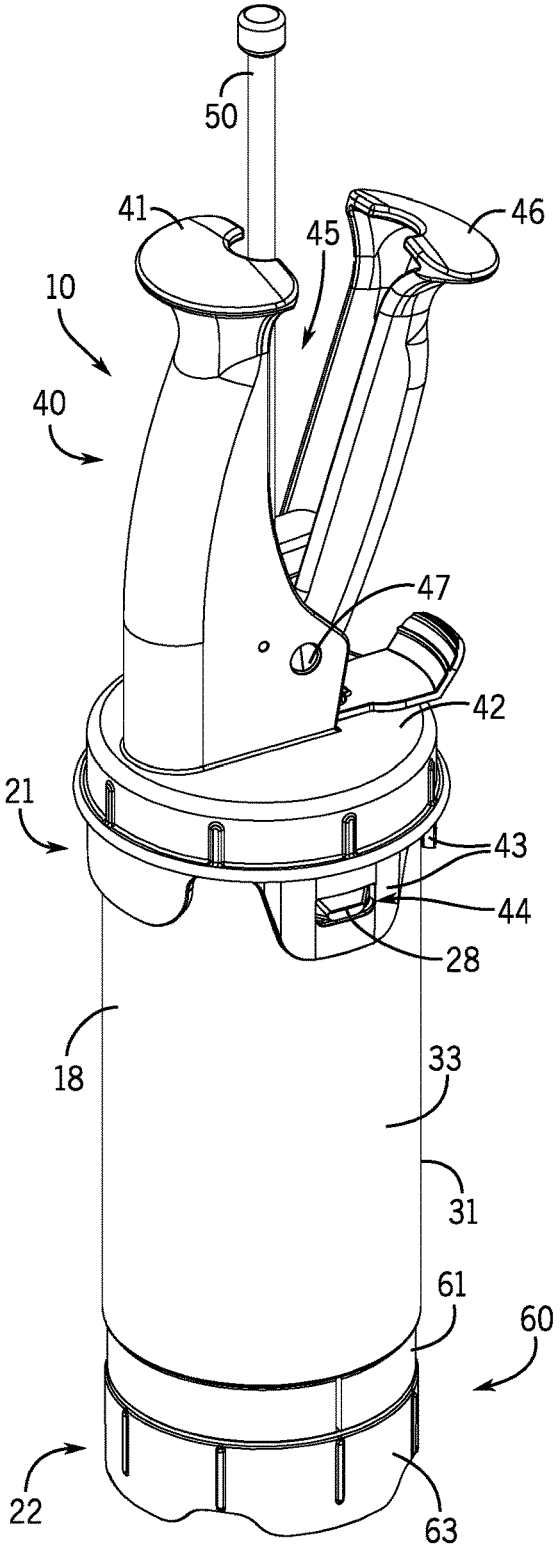
FIG. 1 is a perspective view of a dispenser in accordance with the present disclosure.
Figure 2:
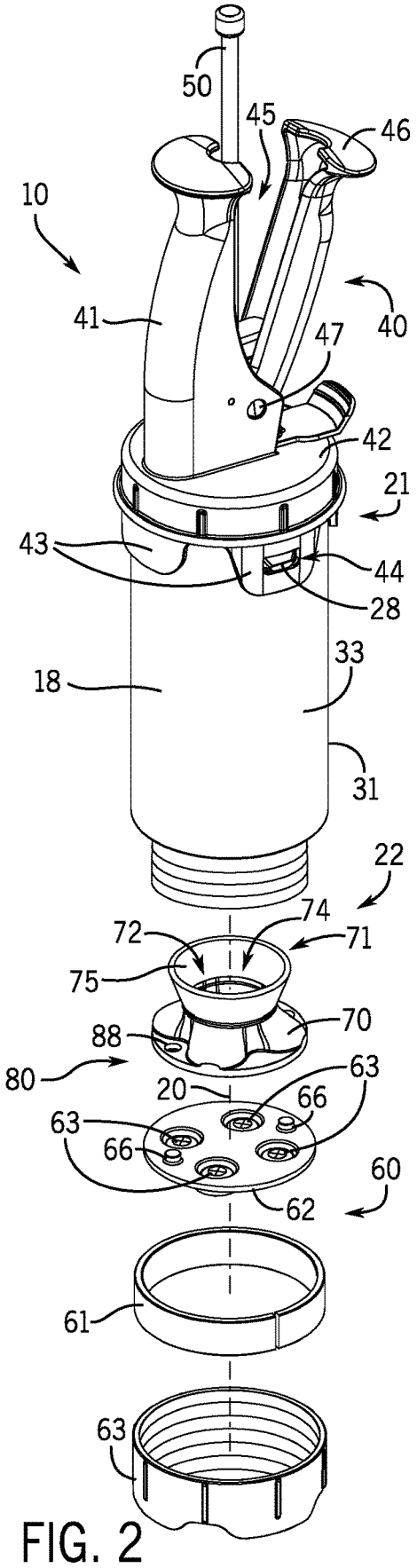
FIG. 2 is an exploded view of the dispenser shown in FIG. 1.

Depicted in FIGS. 1-5 is an dispenser 10 for dispensing viscous materials according to the present disclosure. The dispenser 10 has a body 18 that extends along a longitudinal axis 20 and defines a cavity 19 in which a flexible package 14 (FIG. 5) containing a food product is received. The flexible package 14 is typically pre-filled with a thick, flowable food product, such as ketchup, cheese or other similar product. The flexible package 14 is closed at first and second end walls 16, 17 to retain the food product within the flexible package prior to dispensing. The second end wall 17 of the flexible package 14 includes a dispensing fitment 23 and the portion of the end wall 17 aligned with the fitment 23 is weakened and thus designed to burst in response to a pressure applied to the first end wall 16 by a piston 52 so that the food product will flow out of the dispenser 10.

The body 18 has a first end 21, an opposite, threaded second end 22, and a sidewall 31 extending between the ends 21, 22. The sidewall 31 has an interior surface 32 and an opposite, exterior surface 33. A wall member 24 extends radially inwardly from the interior surface 32 into the cavity 19 to divide the cavity 19 into a first cavity portion 19*a* (e.g. package receiving cavity) and second cavity portion 19*b* (e.g. insert receiving cavity). The wall member 24 has a first wall surface 26 positioned next to the package receiving cavity 19*a*, an opposite second wall surface 27 positioned next to the insert receiving cavity 19*b*, and a passage 25 extending between the surfaces 26, 27 such that the package receiving cavity 19*a* is in fluid communication with the insert receiving cavity 19*b*. The passage 25 is sized to receive the fitment 23 as illustrated.

The body 18 includes a handle assembly 40 that is removably coupled to the first end 21 of the body 18 and is operated by an operator to dispense food product from the dispenser 10. The handle assembly 40 includes a fixed handle 41 integrally joined to a cap 42 that engages with the first end 21 of the body 18. The cap 42 has flanges 43 that extend parallel to the longitudinal axis 20, and each flange 43 includes a cutout 44 that receives a tab 28 projecting from the exterior surface 33 of the sidewall 31 to thereby couple the handle assembly 40 to the body 18. Specifically, the handle assembly 40 is coupled to the body 18 by elastically deforming the flanges 43 such that the tabs 28 are received into the cutouts 44. To decouple the handle assembly 40 from the body 18, the flanges 43 are pulled radially outwardly such that the tabs 28 are not disposed in the cutouts 44 and the handle assembly 40 can be pulled away from the body 18. In another contemplated embodiment, the handle assembly 40 can be coupled to the body 18 via a threaded connection.

Figure 3:
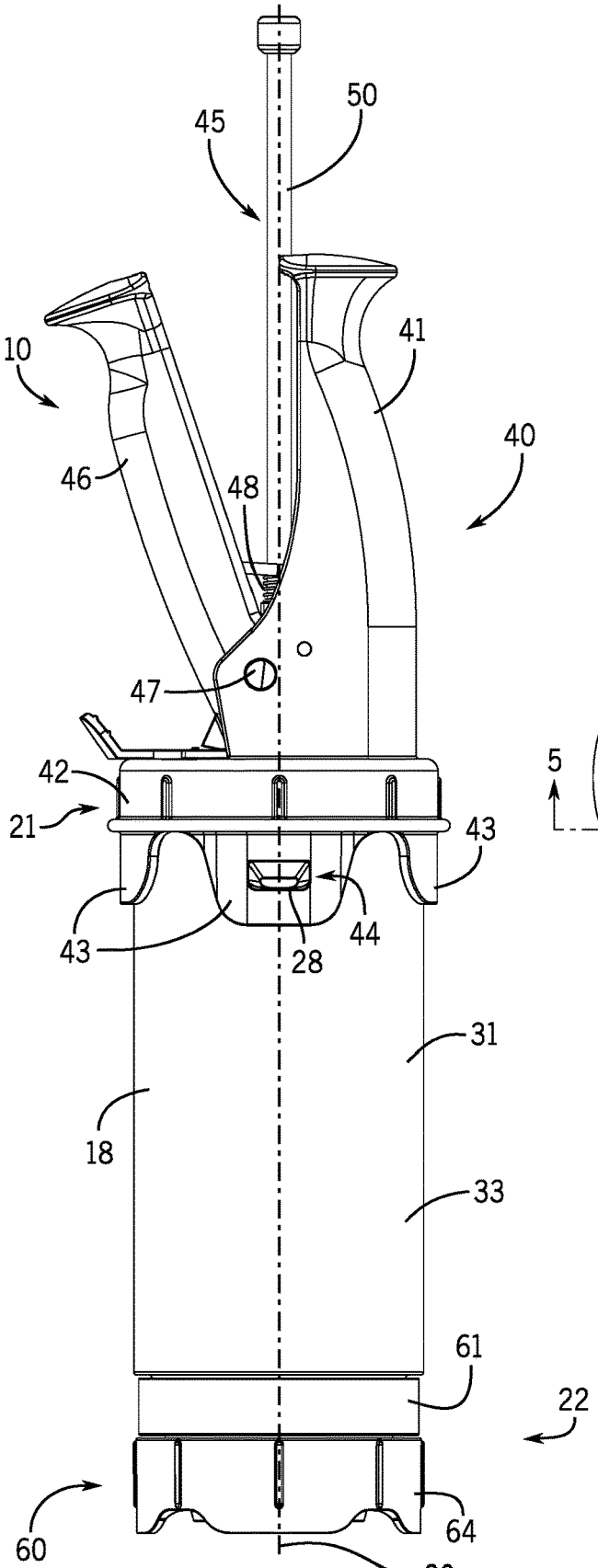
FIG. 3 is a side view of the dispenser shown in FIG. 1.
Figure 4:
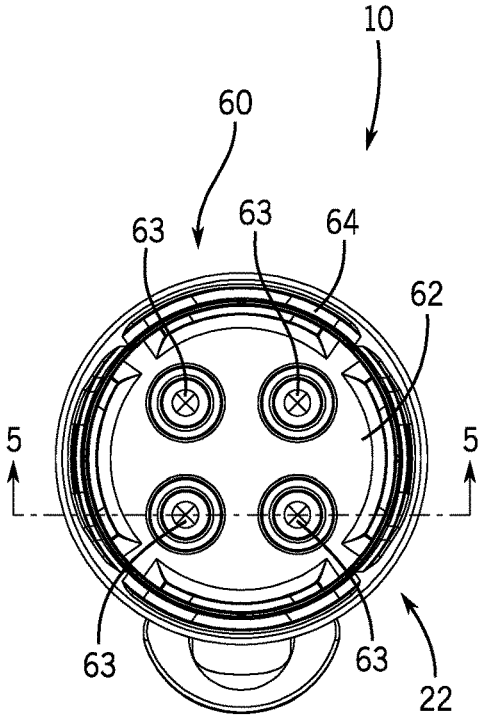
FIG. 4 is an end view of the dispenser shown in FIG. 1.
Figure 5:
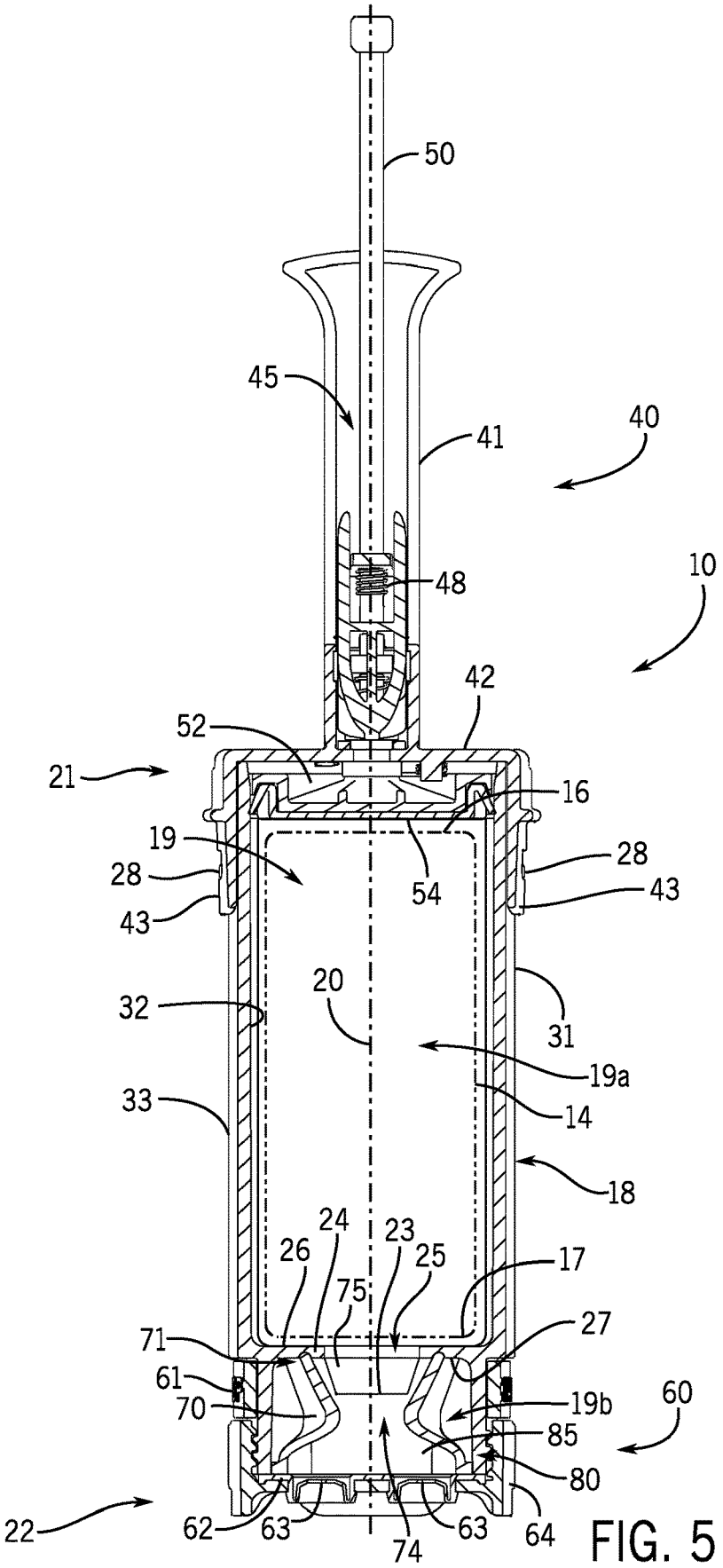
FIG. 5 is a cross sectional view of the dispenser shown in FIG. 1 along line 5-5 on FIG. 4.
Figure 6:
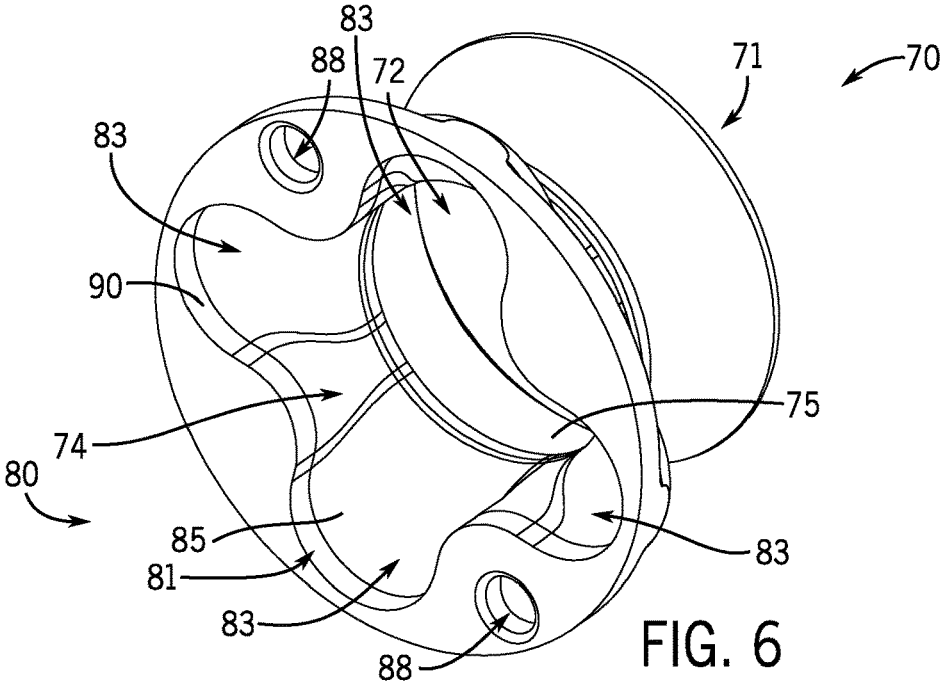
FIG. 6 is a perspective view of a diverter insert of the present disclosure.
Figure 7:
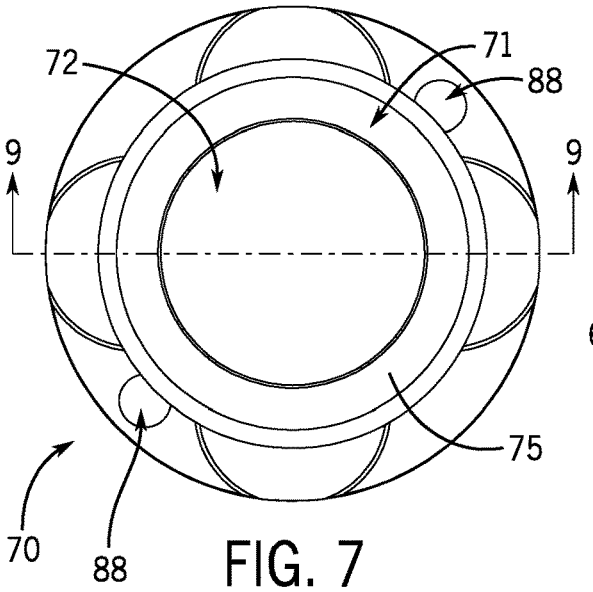
FIG. 7 is a top plan view of the diverter insert shown in FIG. 6.

The handle assembly 40 includes a trigger 46 pivotably attached to the fixed handle 41 such that the operator can pivot the trigger 46 into and between an open position (FIG. 3) and a closed position (not shown). In operation, the operator pivots the trigger 46 relative to the fixed handle 41 to thereby dispense food product from the dispenser 10. The trigger 46 is pivotably attached to the fixed handle 41 by a pivot pin 47 which extends through respective aligned holes (not shown) in the trigger 46 and the fixed handle 41. The trigger 46 is pivoted into and out of a recess 45 defined in the fixed handle 41. The trigger 46 is normally biased by a spring 48 (FIG. 5) to an open position as depicted in FIG. 3 and is designed to be moved against the bias of the spring 48 to a closed position (not shown) substantially within the recess 45 and/or against the fixed handle 41.

An elongated reciprocating rod 50 is coupled to the trigger 46 and is mounted for axial movement along the longitudinal axis 20 in the package receiving cavity 19*a* as the trigger 46 is pivoted. A piston 52 is coupled to the rod 50 by a pawl mechanism (not shown) that permits the rod 50 and the piston 52 to be incrementally moved within the package receiving cavity 19*a* such that the piston 52 applies a pressure to the flexible package 14 to thereby dispense the food product.

The piston 52 has an extended portion 78 with an opening that receives the rod 58 and a bearing surface 54 which acts on the flexible package 14. The shape of the bearing surface 54 corresponds to the shape of the first wall surface 26 of the wall member 24. When the piston 52 is moved into close proximity with the wall member 24, the bearing surface 54 and first wall surface 26 sandwich the flexible package 14 when substantially all of the food product is forced from the flexible package and through the passage 25. Accordingly, little or no food product is trapped in the package receiving cavity 19*a*. In the example depicted in FIG. 5, the bearing surface 54 is flat and circular and the first wall surface 26 of the wall member 24 is flat and circular. In another example (not shown), the bearing surface 54 and the first wall surface 26 are funnel-shaped and sloped toward the second end 22 of the body 18. In contrast, if the bearing surface 54 does not correspond to the first wall surface 26 of the wall member 24, an amount of food product becomes trapped there between in the package receiving cavity 19*a*. For instance, if the bearing surface 54 is circular and flat and the first wall surface 26 of the wall member 24 is funnel-shaped and sloped toward the second end 22 of the body 18, food product will become trapped between these surfaces 26, 54 due the bearing surface 54 contacting the wall member 24 before all the food products thereby stopping movement of the piston 52.

The food product passing through the fitment 23 centered in the passage 25 in the wall member 24 is received into a diverter insert 70. The diverter insert 70 is retained in the insert receiving cavity 19*b* by a removable collar assembly 60 of the body 18 that is coupled to the second end 22 of the body 18. The collar assembly 60 includes a dispensing disc 62 having a plurality of one-way flexible dispensing valves 63. Each of the dispensing valves 63 allows the food product to exit from the dispenser 10. A cover 64 engages with the threaded second end 22 of the body 18 to hold the dispensing disc 62 in place. The cover 64 forces the dispensing disc 62 into contact with the diverter insert 70 such that a fluid tight seal is formed between the diverter insert 70 and the dispensing disc 62 and between the diverter insert 70 and the wall member 24. The dispensing disc 62 can include any number and size of dispensing valves 63. In the example depicted in FIG. 4, the dispensing disc 62 includes four circular dispensing valves 63. The dispensing valves 63 are designed as one-way valves having a slit opening near the center and are formed from a flexible material, such as silicone. The dispensing disc 62 is interchangeable with other dispensing discs depending on the desired dispensing pattern for the dispenser 10. The dispensing valves 63 are each radially offset from the longitudinal axis 20. In the embodiment shown in FIG. 2, the dispensing disc 62 includes a pair of alignment bosses 66 which facilitate alignment of the diverter insert 70 with the dispensing disc 62 and the included dispensing valves 63.

The collar assembly 60 also includes a spacing ring 61 disposed around the second end 22 of the body 18. The spacing ring 61 is removable and interchangeable with other spacing rings 61. It is contemplated that the spacing ring 61 can be imprinted with indicia to alert the operator as to what food product is loaded and dispensed from the dispenser 10. For example, the spacing ring 61 may include "SPECIAL SAUCE", "KETCHUP" or "BBQ SAUCE" imprinted thereon. In other instances, the spacing ring 61 could be colored to correspond with the food product that is dispensed from the dispenser. For example, a red colored spacing ring 61 is used when ketchup is dispensed from the dispenser 10 and a yellow colored spacing ring 61 is used when mustard is dispensed from the dispenser 10.

The diverter insert 70 disposed in the insert receiving cavity 19*b* is configured to receive the food product passing through the passage 25 and divert the food product to each of the dispensing valves 63. The diverter insert 70 is centered on the longitudinal axis 20. As shown in FIGS. 6-9, the diverter insert 70 includes an inlet end 71 having an inlet opening 72 through which the food product in received into a chamber 74 defined in the diverter insert 70. The chamber 74 is tapered from the inlet opening 72 to a transition area 73. At the transition area 73, the material enters into one of a plurality of dispensing sections 83 which extend through the lower portion of the diverter insert 70 and each terminate at an outlet end 80. Each of the dispensing sections 83 terminates at one of the plurality of outlet openings 81 through which the food product is dispensed to one of the dispensing valves 63.

Figure 8:
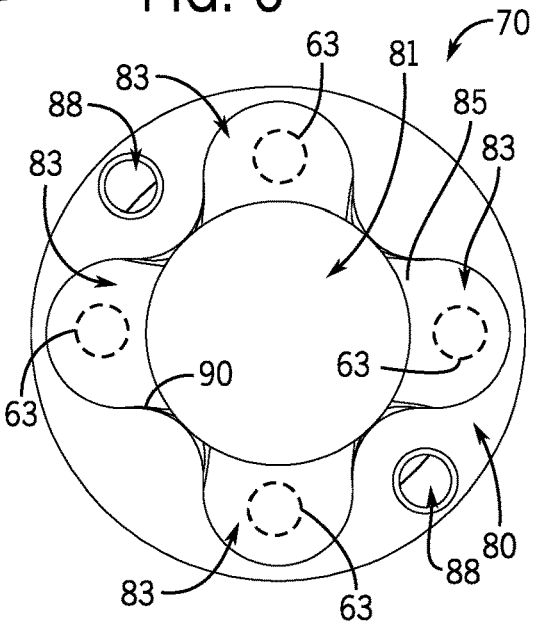
FIG. 8 is a bottom plan view of the diverter insert shown in FIG. 6.
Figure 9:
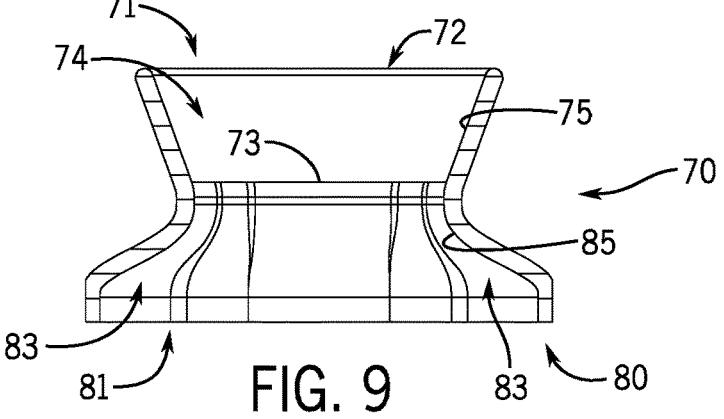
FIG. 9 is a cross sectional view of the diverter insert shown in FIG. 6 along line 9-9 on FIG. 7.

The chamber 74 has a first interior sidewall 75 that radially inwardly slopes from the inlet opening 72 toward the longitudinal axis 20 and terminates at a second interior sidewall 85 which radially outwardly slopes away from the longitudinal axis 20 and toward the outlet openings 81. The first interior sidewall 75 radially inwardly diverts the food product toward the longitudinal axis 20 and the second interior sidewall 85 radially outwardly diverts the food product toward the dispensing valves 63. The outlet openings 81 are each shaped such that food product is directed toward one of the dispensing valves 63. For example, as shown in FIG. 8, the outlet end 80 has four dispensing sections 83 that terminate in the outlet openings 81 that are equally radially spaced apart from each other relative to the longitudinal axis 20. The dispensing sections 83 and the corresponding outlet openings 81 generally align with the four dispensing valves 63 (see FIG. 4) of the dispensing disc 62 (note that the dispensing valves 63 are shown in dashed lines on FIG. 8). The outlet openings 81 define an inner edge 90 that is undulated or wavy. Furthermore, each dispensing section 83 directs the flow of material to the corresponding outlet opening 81, which is generally shaped to match the shape of the dispensing valves 63, and the second interior sidewall 85 includes smooth, curved surfaces that allow the food product easily flow through the chamber 74 and through the outlet openings 81.

The outlet end 80 of the diverter insert includes a pair of alignment holes 88 that receive the alignment bosses 66 on the dispensing disc 62 to align the dispensing sections 83 with the dispensing valves 63. Proper alignment of the dispensing sections 83 and the dispensing valves 63 is important to ensure efficient and effective flow of the food product through the diverter insert 70 and to the dispensing valves 63. The dispensing sections 83 are in fluid communication with each other (e.g. there are no barrier structures between the dispensing sections 83).

An example operation of the dispenser 10 is described herein below, and a person of ordinary skill in the art will recognize that the operation of the dispenser 10 can vary.

To load the dispenser 10 with the flexible package 14, the handle assembly 40 is decoupled from the body 18 and the flexible package 14 is inserted into the package receiving cavity 19*a* and the fitment 23 is located within the passage 25. The handle assembly 40 is then coupled to the body 18 thereby confining the flexible package 14 in the package receiving cavity 19*a*.

To dispense the food product, the trigger 46 is squeezed towards the fixed handle 41 which results in axial movement of the rod 50 along the longitudinal axis 20. Accordingly, the rod 50 and the piston 52 is advanced incrementally within the packaging receiving cavity 19*a* due to frictional contact between the rod 58 and an opening in the pawl mechanism. When the trigger 46 is released, the force of spring 48 will cause the rod 50 to shift back away from the flexible package 14, and the piston 52 will decouple from the rod 50. The piston 52 remains in the same position until the trigger 46 is squeezed again. Repeated squeezing and releasing of the trigger 46 will enable the piston 52 to be moved toward the flexible package 14 until the food product is fully forced from the flexible package 14.

The initial movement of the piston 52 exerts a pressure on the flexible package 14 which will cause bursting of the second end wall 17 of the flexible package 14 at the location of the fitment 23. Further movement of the piston 52 compresses the flexible package 14 causing the food product to be forced out of the flexible package 14 and through the passage 25 defined in the wall member 24. The food product is then received into the chamber 74 of the diverter insert 70. The chamber 74 fills with food product, and after the chamber 74 is completely filled with food product, additional food product received into the chamber 74 causes food product to be diverted into the dispensing sections 83, which divert the food product toward one of the dispensing valves 63. The trigger 46 is repeatably squeezed to dispense the food product from the dispenser 10.

To reload or refill the dispenser 10 when the flexible package 14 is empty, the handle assembly 40 is decoupled from the body 18 so that the used flexible package 14 can be removed and a new flexible package 14 can be inserted into the package receiving cavity 19*a*. To reset the handle assembly 40, the piston 52 is moved along the rod 50 to its original position. Thereafter, the handle assembly 40 is recoupled to refilled body 18, as described above. While the new flexible package 14 is inserted into the package receiving cavity 19*a*, the food product in the chamber 74 is retained in the chamber 74 due to the vicious properties of the food product and the shape of the chamber 74. If for instance, the dispenser 10 is inverted to remove the used flexible package 14 the food product in the chamber 74 remains in the chamber 74 and does not spill out. As new food product is forced into the chamber 74, the residual food product in the chamber 74 is dispensed through the dispensing valves 63. As such, food product in the diverter insert 70 is not wasted or lost when the dispenser 10 is refilled.

The present inventors have found that the dispenser 10 and the diverter insert 70 of the present disclosure greatly reduces the amount of food product which must be cleaned/removed from the dispenser 10 each time the dispenser is refilled. In conventional dispensers, an amount of residual food product is often trapped below the piston and above the dispensing opening due to the piston not fully compressing the flexible package and dispensing the food product there from. Accordingly, when the nearly emptied flexible package is removed from the dispenser the residual food product is trapped in the flexible package and/or in the dispenser between the piston and the dispensing holes. This residual food product is often placed in the trash or cleaned from the dispenser prior to a new flexible package being added to the dispenser. In contrast, the dispenser 10 of the present disclosure minimizes or eliminates the amount of residual food product that is wasted. Accordingly, the dispensing efficiency of the dispenser 10 of the present disclosure is greater than conventional dispensers. The diverter insert 70 of the present disclosure increases the flow rate of the food product between the flexible package 14 and the dispensing valves 63 and reduces buildup of large particles that may normally collect in at the sides or corners of conventional dispensers with conventional nozzles.

In the present disclosure, certain terms have been used for brevity, clarity and understanding. No unnecessary limitations are to be inferred therefrom beyond the requirement of the prior art because such terms are used for descriptive purposes and are intended to be broadly construed. The different systems, apparatuses and method steps described herein may be used alone or in combination with other systems, apparatus and method steps. It is to be expected that various equivalents, alternatives and modifications are possible within the scope of the appended claims. Each limitation in the appended claims is intended to invoke interpretation under 35 USC § 112(f), only if the term "means for" or "step for" are explicitly recited in the respective limitation.

What is claimed is:

1. A dispenser for dispensing a viscous material contained in a flexible package having a dispensing fitment, the dispenser comprising:

a hollow body extending along a longitudinal axis and having a first end, an opposite second end and a cavity positioned therebetween configured to receive the flexible package;

a plurality of dispensing valves positioned at the second end of the hollow body;

a piston movably disposed in the cavity for engagement with the flexible package; and a diverter insert positioned in the cavity and configured to receive the viscous material from the flexible package as the piston moves and to divert the viscous material to the plurality of dispensing valves, wherein each of the plurality of dispensing valves are radially offset from the longitudinal axis and wherein the diverter insert has a first interior sidewall configured to receive the dispensing fitment of the flexible package and a second interior sidewall configured to radially outwardly divert the viscous material from the first interior sidewall to the dispensing valves.

2. The dispenser according to claim 1, wherein the body further comprises:

a sidewall that extends between the first end and the second end, the sidewall having an interior surface; and a wall member that extends radially inwardly from the interior surface into the cavity to thereby divide the cavity into a first cavity portion in which the flexible package is received and a second cavity portion in which the diverter insert is disposed, wherein the wall member has a passage there through such that the first cavity portion is in fluid communication with the second cavity portion.

3. The dispenser according to claim 2, wherein the wall member has a first wall surface adjacent to the first cavity portion, wherein the piston has a bearing surface and wherein the bearing surface and first wall surface are configured to compress the flexible package there between as the food product is forced from the flexible package.

4. The dispenser according to claim 1 wherein the diverter insert is removably disposed in the cavity.

5. The dispenser according to claim 1, wherein the dispenser includes a dispensing disc that includes the plurality of dispensing valves.

6. The dispenser according to claim 5, wherein the dispensing disc has at least one alignment boss extending therefrom and the diverter insert has at least one alignment hole sized to receive the alignment boss when the dispensing disc and the diverter insert are positioned within the hollow body.

7. The dispenser according to claim 1, wherein the body further comprises a collar assembly having a dispensing disc in which the plurality of dispensing valves are disposed and a cover that couples to the second end of the body and positions the dispensing disc next to the second end the body; and wherein the cover presses the dispensing disc into contact with the diverter insert such that a first fluid tight seal is formed between the diverter insert and the dispensing disc and a second fluid tight seal is formed between the diverter insert and the wall member.

8. The dispenser according to claim 7, wherein the dispensing disc has an alignment boss extending therefrom, and wherein the diverter insert has an alignment hole in which the alignment boss is received such that the dispensing sections of the diverter insert are aligned with the dispensing valves.

9. The dispenser according to claim 1 wherein the first sidewall directs the viscous material along the longitudinal axis.

10. The dispenser according to claim 1 wherein the fitment is in contact with the first sidewall to retain the fitment within the diverter insert.

* * * * *